United States Patent [19]

Zwicker et al.

[11] Patent Number: 4,712,244

[45] Date of Patent: Dec. 8, 1987

[54] DIRECTIONAL MICROPHONE ARRANGEMENT

[75] Inventors: Eberhard Zwicker, Icking; Thomas Beckenbauer, Muenchen; Guenther Beer, Erlangen, all of Fed. Rep. of Germany

[73] Assignee: Siemens Aktiengesellschaft, Berlin and Munich, Fed. Rep. of Germany

[21] Appl. No.: 918,497

[22] Filed: Oct. 14, 1986

[30] Foreign Application Priority Data

Oct. 16, 1985 [DE] Fed. Rep. of Germany ..... 3536885

[51] Int. Cl.[4] ..... H04R 25/00; H04R 1/20; H04R 1/04

[52] U.S. Cl. ..... 381/68.1; 381/68.5; 381/92; 381/120; 381/122; 381/155; 381/168; 381/187

[58] Field of Search ..... 381/68.1, 68.5, 68, 381/92, 120, 122, 155, 168, 187

[56] References Cited

U.S. PATENT DOCUMENTS

| | | | |
|---|---|---|---|
| 2,982,942 | 5/1961 | White | 381/155 |
| 4,466,117 | 8/1984 | Görike | 381/155 |

FOREIGN PATENT DOCUMENTS

| | | | |
|---|---|---|---|
| 1272377 | 7/1968 | Fed. Rep. of Germany | 381/68.5 |
| 59-64994 | 4/1984 | Japan | 381/92 |
| 59-67797 | 4/1984 | Japan | 381/92 |
| 59-149494 | 8/1984 | Japan | 381/92 |

OTHER PUBLICATIONS

"Directional Microphone System", Bleazey, John C., *RCA Technical Notes*, Mar. 1962.

*Primary Examiner*—Gene Z. Rubinson
*Assistant Examiner*—Danita R. Byrd
*Attorney, Agent, or Firm*—Hill, Van Santen, Steadman & Simpson

[57] ABSTRACT

A directional microphone arrangement has a number of discrete microphones each having an electrical output and elements for deriving first and second electrical signals which are 180° out of phase with respect to each other from the outputs of the microphones. A third signal is also derived through differentiation from one of the microphone outputs which is 90° out of phase with respect to one of the first or second signals. All of the first, second and third signals are added in a summing unit, the output of the summing unit forming the output for the arrangement.

25 Claims, 6 Drawing Figures

DIRECTIONAL MICROPHONE ARRANGEMENT

BACKGROUND OF THE INVENTION

1. Field of the Invention

The present invention relates to a directional microphone arrangement having a plurality of microphones, the outputs of which are phase shifted and additively or substractively combined.

2. Description of the Prior Art

Microphone arrangements are known in the art which include a plurality of discrete directional microphones, the outputs of these microphones being phase shifted relative to each other and combined by adding or subtracting. Examples of such known arrangements are described in combination with a zoom microphone in U.S. Pat. Nos. 4,399,327, and 4,412,097, and in the article "Zoom-Mikrofon," Funkschau, 1980, No. 19, pages 79–80. These known directional microphone arrangements have at least three discrete microphones which are individually directional (cardioid pattern) in design. Such microphones are relatively bulky, complex and expensive. The directional discrete microphones are disposed with respect to each other so that two microphones are always directed in the direction toward the sound source, whereas a third microphone is directed away from the sound source. The outputs of the three microphones are additively and/or subtractively combined by potentiometers. By means of the potentiometers, the signal voltage of the discrete microphone directed away from the sound source can be driven to zero. A 180° phase shifter is also used for offsetting the sound signals incident from the lateral directions by 180° relative to each other, so that these signals are cancelled in the adder stage. This results in a directional pattern only toward the front of the arrangement, i.e., in the direction toward the sound source.

A directional microphone arrangement is also disclosed in German OS No. 22 36 968 for a hearing aid which includes at least two sets of microphones, each set including at least two microphones. One set of microphones is disposed at the distal end of one bow of a pair of eyeglasses, and the second set is arranged at the distal end of the second bow of the pair of eyeglasses to be worn by a hearing-impaired person. The microphones within a set are disposed such that their respective directions of maximum signal reception are perpendicular to each other. In this known system, as in the systems described above, microphones which are individually designed as directional microphones are used. The outputs of the discrete microphones are additively and/or subtractively combined by weighting elements. The weighting elements differently weight the sound signals incident at the front and at the sides of the arrangement so that the influence of the sound signals incident at the sides of the arrangement is reduced to a minimum in comparison to the signals incident at the front of the arrangement A front directional effect is thus achieved.

Another directional microphone arrangement is disclosed in U.S. Pat. No. 4,334,740 (corresponding to French Published Application No. 24 36 416 and German OS No. 29 36 082). This arrangement is suitable for cameras and employs integrators having a transfer constant. The transfer constant, however, decays toward high frequencies, so that additional low pass filters and high pass filters are required for reconstructing the higher frequencies.

SUMMARY OF THE INVENTION

An object of the present invention is to provide a directional microphone arrangemnt which can be constructed using non-directional discrete microphones, such as omni-directional microphones.

Another object of the present invention is to provide such a directional microphone arrangement which is simple in construction and is suited for use in hearing aids.

The above objects are achieved in accordance with the principles of the present invention in a directional microphone system having a plurality of non-directional microphones each having an electrical output, means for deriving first and second electrical signals which are 180° out of phase with respect to each other from respective outputs of the plurality of microphones, means for deriving through differentiation a third electrical signal from one of the outputs of the plurality of microphones which is 90° out of phase with respect to one of the first or second signals, and means for summing the first, second and third electrical signals thereby forming an output signal for the system.

The system disclosed herein allows the use of non-directional microphones, particularly omni-directional microphones, together with a differentiating element which exhibit an increasing transfer constant toward high frequencies. This directional microphone arrangement requires no further filters The system is therefore technologically simply, inexpensive and particularly suited for assisting hearing-impaired persons, for whom the higher frequencies are especially important for speech comprehension.

A particularly distinct directional effect is obtained by the use of two sets of microphones, with the aforementioned first, second and third signals being derived for each set of microphones. In this embodiment, two hypercardioid signals are added, so that the overall directional effect becomes even sharper.

The system can be easily arranged within one or both bows of eyeglasses to be worn by a hearing-impaired person. The output signals can be supplied to one ear or both ears of such a person.

The concept of using two sets of microphones in a hearing aid can be used to advantage with discrete directional microphones as well, in an embodiment with two sub-miniature discrete microphones combined in a summing element. Directional sub-miniature discrete microphones are commercially available such as, for example, Knowles model EB series, however, such microphones have the disadvantage that the directional effect becomes poor in the upper frequency range, which is important for speech comprehension.

DESCRIPTION OF THE PREFERRED EMBODIMENTS

Figure 1:
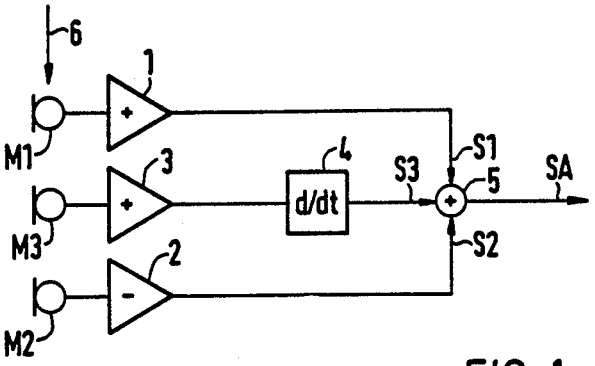
FIG. 1 is schematic circuit diagram of a directional microphone arrangement constructed in accordance with the principles of the present invention using three discrete microphones.

A directional microphone system construction in accordance with the principles of the present invention is shown in a first embodiment in FIG. 1. In FIG. 1, three omni-directional microphone buttons M1, M2 and M3 (for example, Knowles omni-directional microphones) are connected to a summing unit 5 through amplifiers 1, 2 and 3. The output of the amplifier 3 is connected to the summing unit through a differentiating element 4 having variable primary gain. The amplifier 2 is an inverting amplifier, thus the microphone signal S2 derived from the microphone M2 by the amplifier 2 is shifted in phase by 180° with respect to the microphone signal S1 derived from the microphone Ml through the amplifier 1. A pressure difference receiver having a dipole directional characteristic is thus simulated. The differentiating element 4 functions as a 90° phase shifter having variable primary gain. By superimposing the output signal S3 of the differentiating element 4 with the signal S1 and S2, a pronounced directional characteristic is achieved, for example a hypercardioid characteristic. This characteristic can be set for the overall system given suitable selection of the primary gain of the differentiating element 4. The microphones M1 through M3 receive sound which is preferably incident from the direction of the arrow 6. The output signal Sa of the summing unit 5 is the output signal for the system, and is primarily formed by sound received in the direction of arrow 6.

Figure 2:
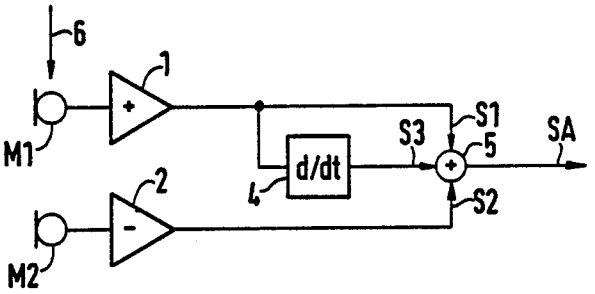
FIG. 2 is a schematic circuit diagram of a second embodiment of a directional microphone arrangement constructed in accordance with the principles of the present invention using two microphones.

A second embodiment of this system is shown in FIG. 2 which uses only two omni-directional microphone buttons M1 and M2. In this embodiment, the differentiating element 4 is directly connected to the output of the amplifier 1. The first and second microphone signals S1 and S2 are derived as described in connection with FIG. 1, whereas the third microphone signal S3 is in this embodiment derived from the first microphone M1. The same result as in the embodiment of FIG. 1 is achieved, but with considerably simplified technologically outlay.

Figure 3:
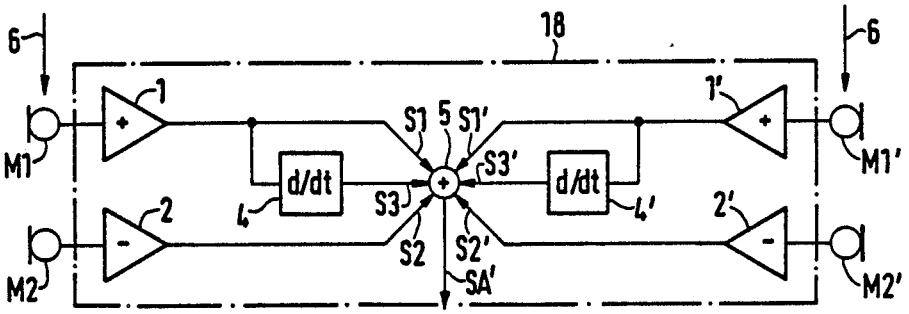
FIG. 3 is a schematic circuit diagram of a directional microphone arrangement constructed in accordance with the principles of the present invention using two sets of microphones.

An even more distinct directional characteristic is obtained by combining two hypercardioid signals generated independently of each other by separate sets of microphone arrangements, each set being constructed in accordance with either FIG. 1 or FIG. 2. Such an embodiment is shown in FIG. 3. This embodiment has a first set consisting of two omni-directional microphone buttons M1 and M2 disposed at the left side of the system, and a second set consisting of two omni-directional microphone buttons M1' and M2' at the right side of the microphone system. The outputs of the microphones Ml and M2 are supplied to the summing unit 5 as described in connection with FIG. 2. The respective outputs of the microphones M1' and M2' are in an identical manner supplied to the summing unit 5 via amplifiers 1' and 2'. The output of the amplifier 1' is also supplied to the summing unit 5 via another differentiating unit 4'. The summing unit 5 combines the signals S1, S2 and S3 from the first microphone set with the signals S1', S2' and S3' from the second microphone set to form a system output SA'. The components, 1, 2, 4, 5, 1', 2' and 4' can be contained, such as by integrating, in a housing 18.

The embodiment of FIG. 3 can also be constructed using three mcirophones in each microphone set, in accord with FIG. 1 The summing unit 5 may alternatively consist of three adder stages, namely a first adder stage for adding the signals S1 through S3, a second adder stage for adding the signals S1' through S3', and a third adder stage for adding the output signals of the first and second adder stages. It is also possible to make the amplifier 1 (or 1') and inverting amplifier and the amplifier 2 (or 2') a non-inverting amplifier. Alternatively the amplifier 2 (or 2') may be a non-inverting amplifier with a subsequent inverting element. A further possibility is to make the amplifier 2 a non-inverting amplifier and provide an inverting input (or subtraction input) at the summing unit 5 for the microphone signal S2.

Figure 4:
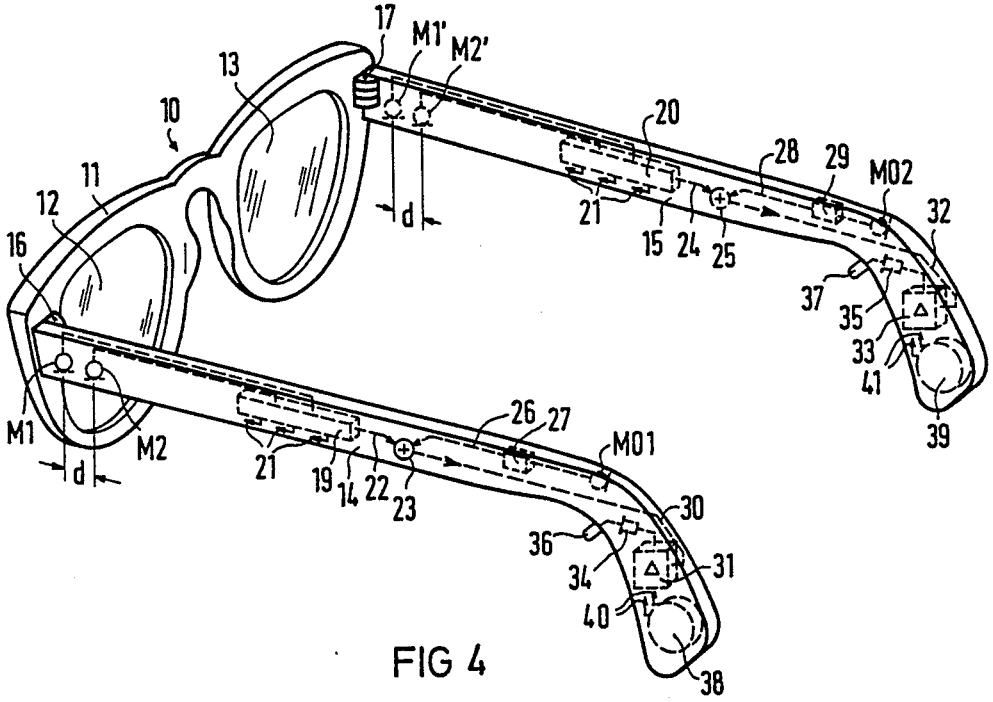
FIG. 4 shows employment of the embodiment of FIG. 3 in a pair of eyeglasses for use in a hearing aid.

The employment of the embodiment of FIG. 3 in a hearing aid in a pair of eyeglasses 10 is shown in FIG. 4. The eyeglasses 10 include an eyeglass frame 11 supporting lenses 12 and 13 and a left bow 14 and a right bow 15. Both bows 14 and 15 are hinged to the frame 11 by respective hinges 16 and 17. The omni-directional microphone pair Ml and M2 is disposed in the left bow 14 in the proximity of the hinge 16. Correspondingly, the second omni-directional microphone pair M1' and M2' is arranged in the right bow 15 in the proximity of the hinge 17. The two microphones of each microphone pair are disposed in sequence generally along a line extending from the respective hinge. The spacing d between the microphones is in the range of about 3 through about 7 mm, preferably 5 mm. The components for processing the output signals of each microphone pair are respectively contained in electron blocks 19 and 20 in the embodiment of FIG. 4.

The two blocks 19 and 20 are connected to each other by lines 21 which may be conducted through the bows 14 and 15 and the frame 11 (not shown in greater detail) or connected to each other by some other type of cable run.

In the bow 14, the output line for the signal SA' is supplied to another adder element 23 via a branch line 22. In the other bow 15, the signal SA' is supplied via a further branch line 24 to an adder element 25. The output signal of a further omni-directional microphone button M01 filtered in a low pass filter 27 is also supplied to the adder element 23. Correspondingly, the adder element 25 in the other bow 15 receives the signal of an omni-directional microphone button M02 on line 28 from a low pass filter 29. The adder element 23 has an output connected to the input of an amplifier 31 via a signal line 30. The output of the adder element 25 is supplied to the input of an amplifier 33 via a signal line 32. The receiver 34 for the left ear canal of a hearing impaired person is connected to the output of the amplifier 31, and an receiver 35 for the right ear canal of the hearing impaired person is connected to the output of the amplifier 33. The receivers are usually connected to the ear canals by conduit connections and respective ear olives (not shown). In the exemplary embodiment of FIG. 4, the conduit connection at the left side is reference 36, and the conduit connection at the right side is reference 37. Embodiments are also possible, however, wherein the receiver is disposed in the ear canal, such as for in-ear hearing aids. Respective batteries 38 and 39 are provided in each bow which supply power via respective lines 40 and 41.

The two microphones M01 and M02 function as locating microphones. When the eyeglasses are worn, the left microphone MO1 is disposed directly above the left ear of the user, and the microphone M02 is disposed directly above the right ear of the user. The locating microphones can be alternatively accomodated in the external ear of the user. By means of the two locating microphones M01 and M02, the hearing-impaired person can locate a sound source of interest and turn his or her head with the eyeglasses 10 in the direction of the sound source. With the head directed toward the sound source, the directional microphone system described above can be used to full effect.

Figure 5:
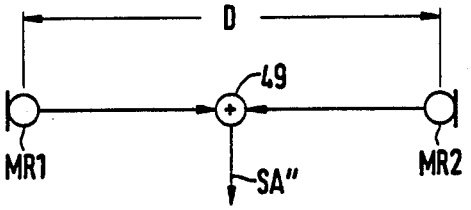
FIG. 5 is a schematic circuit diagram of a modification of the embodiment of FIG. 3 using directional microphones.

A less preferable alternative to the embodiment of FIG. 3 is shown in FIG. 5 which uses sub-minature directional microphones MR1 and MR2 whose outputs are supplied to an adder element 49. The spacing D between the microphones MR1 and MR2, as in FIG. 4, corresponds roughly to the width of the head of the user. In the embodiment of FIG. 4, all components including the microphones are accomodated in the eyeglasses bows. It is also possible to combine these components in modules which are plugged into the bows, with the components being actually located outside of the bows. For those users not requiring eyeglasses, the microphones can be accomodated in a suitable type of head clip.

Figure 6:
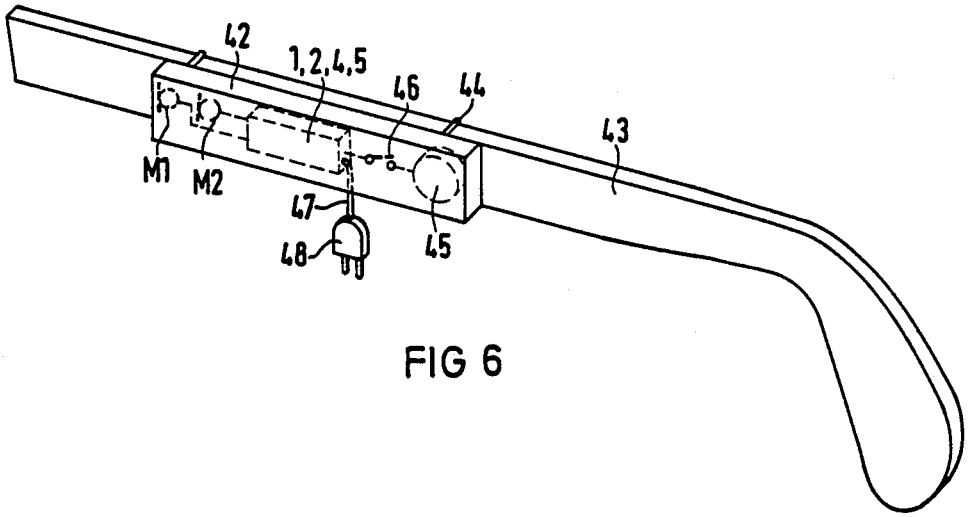
FIG. 6 shows the manner of construction of an embodiment as shown in FIGS. 1 and 2 for use with an existing hearing aid.

An exemplary embodiment wherein a directional microphone arrangement, such as that shown in FIG. 2, can be attached as a separate component part 42 to an eyeglasses bow 43 of a normal pair of eyeglasses as shown in FIG. 6. Any suitable type of clamp, burr closure, adhesive, plug pins or the like can serve for fastening the element 42 to the bow 43. In FIG. 6, the fastening means are generally indicated at 44. The element 44 includes a battery 45 and a switch 46. An output cable 47 having a plug 48 is provided for connection to the audio input of a conventional hearing aid, for example a behind-the-ear hearing aid.

Although modifications and changes may be suggested by those skilled in the art it is the intention of the inventors to embody within the patent warranted hereon all changes and modifications as reasonably and properly come within the scope of their contribution to the art

We claim as our invention:

1. A directional microphone system comprising:

a plurality of non-directional microphones each having an electrical output;

means for deriving first and second electrical signals which are 180° out of phase with respect to each other from respective outputs of said plurality of microphones;

means for deriving through differentiation a third electrical signal from one of the outputs of said plurality of microphones which is 90° out of phase with respect to one of said first or second signals; and means for summing said first, second and third electrical signals thereby forming an output signal for said system.

2. A directional microphone system as claimed in claim 1, wherein said means for deriving said first and second electrical signals comprises:

a non-inverting amplifier connected to an output of one of said microphones forming said first electrical signal; and an inverting amplifier connected to an output of another of said microphones forming said second electrical signal.

3. A directional microphone system as claimed in claim 2, wherein said means for deriving said third electrical signal is connected to one of said non-inverting amplifier or said inverting amplifier for deriving said third electrical signal from one of said first or second electrical signals.

4. A directional microphone system as claimed in claim 3, wherein said means for deriving said third electrical signal is a differentiating element.

5. A directional microphone system as claimed in claim 1, wherein said means for deriving said third electrical signal is a differentiating element.

6. A directional microphone system as claimed in claim 1, wherein said means for deriving said third electrical signal is connected directly to one of the outputs of said plurality of microphones.

7. A directional microphone system as claimed in claim 1, wherein said means for deriving said third electrical signal is connected to one of the outputs of said plurality of microphones through said means for deriving said first and second electrical signals.

8. A directional microphone system as claimed in claim 1, wherein the number of microphones in said plurality of microphones is three, wherein said means for deriving said first and second electrical signals includes an inverting amplifier and a non-inverting amplifier connected to respective outputs of two of said microphones, and wherein said means for deriving said third electrical signal is a differentiating element connected to the output of another of said three microphones.

9. A directional microphone system as claimed in claim 1, wherein the number of microphones in said plurality of microphones is two, wherein said means for deriving said first and second electrical signals includes an inverting amplifier and a non-inverting amplifier connected to respective outputs of said two microphones, and wherein said means for deriving said third electrical signal is a differentiating element connected to the output of one of said inverting amplifier or said non-inverting amplifier.

10. A directional microphone system as claimed in claim 1, further comprising a frame wearable on the head of a person, means for supplying said system output to at least one ear of said person for assisting in hearing, and said system being carried on said frame.

11. A directional microphone system as claimed in claim 10, wherein said frame is a pair of eyeglasses having bows, and wherein said plurality of microphones are disposed in one of said bows.

12. A directional microphone system as claimed in claim 11, wherein said eyeglasses have a lens holding front portion connected to said bows by respective hinges, and wherein said microphones are disposed at a distal end of one of said bows next to one of said hinges.

13. A directional microphone system as claimed in claim 12, wherein said plurality of microphones are disposed in said bow generally along a line extending from said distal end at a selected spacing from each other.

14. A directional microphone system as claimed in claim 13, wherein said spacing is in the range of about 3 through about 7 mm.

15. A directional microphone system as claimed in claim 13, wherein said spacing is about 5 mm.

16. A directional microphone system as claimed in claim 1, further comprising:

a further plurality of non-directional microphones disposed opposite said plurality of non-directional microphones;

means for deriving forth and fifth electrical signals which are 180° out of phase with respect to each other from respective outputs of said further plurality of microphones;

means for deriving through differentiation a sixth electrical signal from one of the outputs of said further plurality of microphones which 90° out of phase with respect to one of said fourth or fifth electrical signals; and said means for summing adding said first, second, third, fourth, fifth and sixth electrical signals thereby forming said system output.

17. A directional microphone system as claimed in claim 16 further comprising:

a pair of eyeglasses having two bows wearable by a hearing-impaired person;

means for supplying said system output to at least one ear of said person for assisting in hearing, said plurality of microphones being disposed in one bow and said further plurality of microphones being disposed in the other bow.

18. A directional microphone system as claimed in claim 17, wherein said eyeglasses have a lens holding front portion connected to said bows by respective hinges, and wherein said plurality of microphones and said further plurality of microphones are disposed at respective distal ends of said bows respectively next to said hinges.

19. A directional microphone system as claimed in claim 18, wherein each of said plurality of microphones and said further plurality of microphones are disposed in a respective bow generally along a line extending from said distal end of the respective bow at a selected spacing from each other.

20. A directional microphone system as claimed in claim 19, wherein said spacing is in the range of about 3 through about 7 mm.

21. A directional microphone system as claimed in claim 19, wherein said spacing is about 5 mm.

22. A directional microphone system as claimed in claim 1, wherein said microphones are omni-directional microphones.

23. A directional microphone system as claimed in claim 1, wherein said microphones are sub-miniature omni-directional microphones.

24. A directional microphone system for assisting hearing-impaired persons comprising:

a pair of eyeglasses to be worn by said person having a lens holding frame portion connected to two bows by respective hinges;

a plurality of non-directional microphones disposed in one of said bows at a distal end thereof next to one of said hinges, each microphone having an electrical output;

means disposed in one of said bows for deriving first and second electrical signals which are 180° out of phase with respect to each other from respective outputs of said plurality of microphones;

means disposed in one of said bows for deriving through differentiation a third electrical signal from one of the outputs of said plurality of microphones which is 90° out of phase with respect to one of said first or second signals;

means disposed in one of said bows for summing said first, second and third electrical signals thereby forming an output signal for said system; and means connected to one of said bows for supplying said system output to at least one ear of said person.

25. A directional microphone system for assisting hearing-impaired persons comprising:

a pair of eyeglasses to be worn by said person having a lens holding frame portion connected to two bows by respective hinges;

a first plurality of non-directional microphones disposed at a distal end of one of said bows next to one of said hinges, each microphone having an electrical output;

means disposed in one of said bows for deriving first and second electrical signals which are 180° out of phase with respect to each other from respective outputs of said first plurality of microphones;

means disposed in one of said bows for deriving through differentiation a third electrical signal from one of the outputs of said first plurality of microphones which is 90° out of phase with respect to one of said first or second signals;

a second plurality of non-directional microphones disposed in the bow opposite said bow containing said first plurality of microphones, each microphone in said second plurality having an electrical output;

means disposed in one of said bows for deriving fourth and fifth electrical signals which are 180° out of phase with respect to each other from respective outputs of said second plurality of microphones;

means disposed in one of said bows for deriving through differentiation a sixth electrical signal from one of the outputs of said second plurality of microphones which is 90° out of phase with respect to one of said fourth or fifth signals;

means disposed in at least one of said bows for summing said first, second, third, fourth, fifth and sixth electrical signals thereby forming an output signal for said sytem; and means connected to said means for summing for supplying said system output signal to at least one ear of said person.

* * * * *